US005470543A

United States Patent [19]

Nagamura et al.

[11] Patent Number: 5,470,543

[45] Date of Patent: Nov. 28, 1995

[54] ULTRA-HIGH PURITY NITROGEN GENERATOR

[75] Inventors: Takashi Nagamura; Takao Yamamoto; Shinji Tomita, all of Hyogo, Japan

[73] Assignee: L'Air Liquide, Societe Anonyme pour l'Etude et l'Exploitation des Procedes Georges Claude, Paris, France

[21] Appl. No.: 325,503

[22] Filed: Oct. 19, 1994

Related U.S. Application Data

[62] Division of Ser. No. 124,072, Sep. 21, 1993.

[30] Foreign Application Priority Data

Sep. 22, 1992 [JP] Japan ..... 4-276830

[51] Int. Cl.[6] ..... B01J 8/02; F25J 3/02; F25J 3/04

[52] U.S. Cl. ..... 422/211; 62/18; 62/27; 62/34; 422/187

[58] Field of Search ..... 422/169, 177, 422/187, 211, 216; 423/351; 62/11, 18, 27, 31, 34

[56] References Cited

U.S. PATENT DOCUMENTS 5,058,387 10/1991 Kamrath ..... 62/11

5,205,127 4/1993 Agrawal ..... 62/24

FOREIGN PATENT DOCUMENTS 0182620 5/1986 European Pat. Off. .
0485612 5/1992 European Pat. Off. .
0589766 3/1994 European Pat. Off. .
2-183789 7/1990 Japan .
5-079754 3/1993 Japan .

*Primary Examiner*—Robert J. Warden
*Assistant Examiner*—Robert Carpenter
*Attorney, Agent, or Firm*—Young & Thompson

[57] ABSTRACT

Ultra-high purity nitrogen is generated by feeding feed air to a carbon dioxide eliminator-drier and a primary rectification column, thereby removing catalyst poisons for an oxidation catalyst used for oxidation of carbon monoxide and hydrogen in the feed air by the carbon dioxide eliminator-drier and the primary rectification column. A part of low purity nitrogen gas separated in the primary rectification column is condensed and liquefied by a condenser. The raw nitrogen gas which has not been condensed and liquefied in the condenser is warmed to normal temperature by a heat exchanger and compressed by a recyclic compressor so that the pressure thereof is increased and the temperature thereof is raised. Carbon monoxide and hydrogen are oxidized in an oxidation column and the resulting carbon dioxide and water are removed by an adsorption column.

5 Claims, 3 Drawing Sheets

ULTRA-HIGH PURITY NITROGEN GENERATOR

This application is a division of application Ser. No. 08/124,072, filed Sep. 21, 1993.

DETAILED DESCRIPTION OF THE INVENTION

1. Technical Field

The present invention relates to an ultra-high purity nitrogen generator, and especially to an ultra-high purity nitrogen generator for generating ultra-high purity nitrogen gas or liquid nitrogen suitable for the manufacture of sub-micron LSI from feed air by use of rectification columns.

2. Prior Art

For example, as disclosed in the official gazette of Japanese Patent Application Laid-open No. 225,568/1986, a high purity nitrogen generating method and a generator therefor have been hitherto proposed, which comprise compressing feed air, passing the feed air having a high temperature as a result of this compression through a column packed with an oxidation catalyst, where carbon monoxide (CO) and hydrogen (H2) are oxidized to carbon dioxide (CO2) and water (H2O), respectively, and then cooling down the feed air and removing these carbon dioxide and water in an adsorption column packed with an adsorbent, and thereafter further cooling down and liquefying the feed air by means of a heat exchanger, and introducing the liquefied feed air to a rectification column to produce a high purity nitrogen product.

PROBLEMS SOUGHT FOR SOLUTION BY THE INVENTION

In the aforementioned prior art, however, SOX, H2S or the like in feed air act as catalyst poisons to reduce the activity of an oxidation catalyst remarkably, because the feed air is compressed and the compressed feed air is directly introduced to a catalyst column. Accordingly, it is necessary to provide an equipment for removing these matters acting as the catalyst poisons at a front stage of the catalyst, to pack the catalyst more than a required amount, into taking consideration the deterioration of its activity, or to provide an equipment for increasing the reaction temperature.

The present invention is intended to eliminate the aforementioned drawbacks.

MEANS FOR SOLUTION OF THE PROBLEMS

One ultra-high purity nitrogen generator according to the present invention comprises:

a carbon dioxide eliminator-drier for removing, from feed air, carbon dioxide, moisture and catalyst poisons;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a compressor for increasing the pressure of the raw nitrogen gas obtained from the primary rectification column and raising the temperature thereof;

an oxidation column for converting carbon monoxide in the compressed raw nitrogen gas to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product;

a heat exchanger for exchanging heat among the feed air to be introduced to the primary rectification column, the raw nitrogen gas obtained from the primary rectification column, the feed raw nitrogen gas to be introduced to the secondary rectification column and the ultra-high purity nitrogen gas product with one another;

a cold box surrounding the heat exchanger and the primary and secondary rectification columns; and a means for removing heat from any of the equipment in the cold box.

A further ultra-high purity nitrogen generator according to the present invention comprises:

a carbon dioxide eliminator-drier for removing, from feed air, carbon dioxide, moisture and catalyst poisons;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for converting carbon monoxide in the compressed raw nitrogen gas to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top portion of the secondary rectification column;

an expansion valve for expanding the liquid nitrogen obtained from the bottom portion of the secondary rectification column and introducing the expanded liquid nitrogen to the primary rectification column as a feed material and refrigerant;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquefied in the nitrogen condenser, the feed raw nitrogen gas to be introduced to the secondary rectification column and the ultra-high purity nitrogen gas product with one another;

a cold box surrounding the heat exchanger, the primary and secondary rectification columns, the gas-liquid separator, the nitrogen condenser and the reboiler-condenser; and a means for removing heat from any of the equipment in the cold box as cold necessary for the above-mentioned rectification.

A further ultra-high purity nitrogen generator according to the present invention comprises:

a carbon dioxide eliminator-drier for removing, from feed air, carbon dioxide, moisture and catalyst poisons;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for converting carbon monoxide in the compressed raw nitrogen gas to carbon dioxide and hydrogen also contained therein to water; and an adsorption column for cooling down the carbon dioxide and water formed through oxidation and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top potion of the secondary rectification column;

an expansion valve for expanding the liquid nitrogen obtained from the bottom portion of the secondary rectification column and introducing the expanded liquid nitrogen to the primary rectification column as a feed material and refrigerant;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquefied in the nitrogen condenser, the feed raw nitrogen gas to be introduced to the secondary rectification column and the ultra-high purity nitrogen gas product with one another; and an expansion turbine for expanding waste gas obtained from the primary rectification column and introducing the expanded waste gas to the heat exchanger as cold.

A further ultra-high purity nitrogen generator according to the present invention comprises:

a carbon dioxide eliminator-drier for removing, from feed air, a carbon dioxide, moisture and catalyst poisons;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for oxidizing the compressed raw nitrogen gas so that carbon nonoxide in the raw nitrogen gas is converted to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top portion of the secondary rectification column;

an expansion valve for expanding the liquid nitrogen obtained from the bottom portion of the secondary rectification column and introducing the expanded liquid nitrogen to the primary rectification column as a feed material and refrigerant;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquefied in the nitrogen condenser, the feed raw nitrogen gas to be introduced to the secondary rectification column and the ultra-high purity nitrogen gas product with one another; and an expansion turbine for taking out a part of the feed raw nitrogen gas to be introduced to the secondary rectification column from the way of the heat exchanger and adiabatically expanding the taken-out nitrogen gas, and introducing the expanded nitrogen gas to the heat exchanger as a refrigerant. The expansion turbine receives the raw nitrogen gas from a point intermediate the warm and cold sides of the heat exchanger.

Referring to the accompanying drawings, the embodiments of the present invention will be described.

Figure 1:
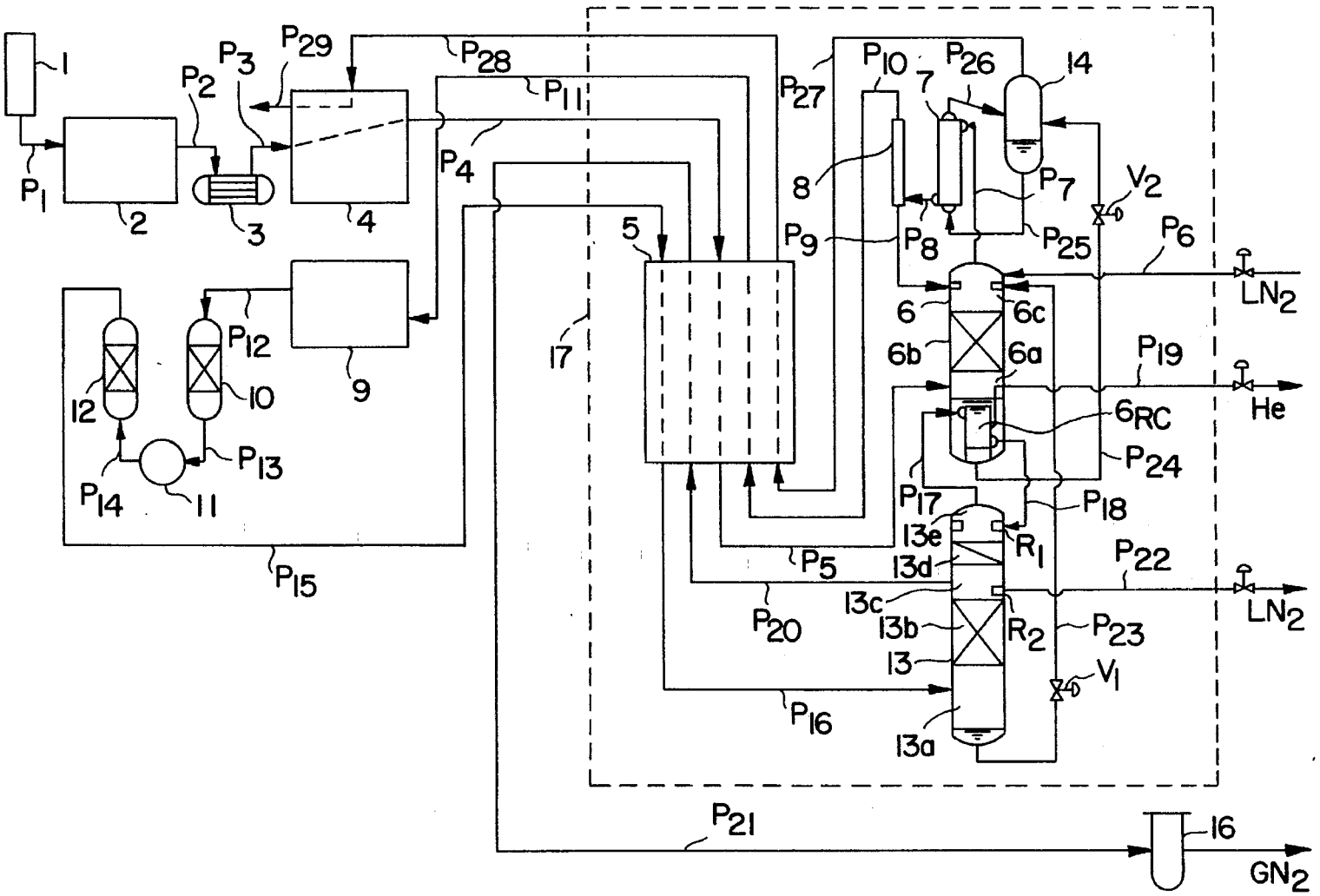
FIGS. 1, 2 and 3 are flow diagrams showing respectively first, second and third preferred embodiments of an ultra-high purity nitrogen generator according to the present invention.

In the present invention, as shown in a flow diagram of FIG. 1, feed air is introduced at 1,000 Nm3/h into an air filter 1 to eliminate dust therefrom, the feed air free from dust is introduced to a compressor 2 through a pipe P1 so as to be compressed to a pressure necessary for the separation of air, for instance, to 6 ATA, and then the compressed feed air is passed though a Freon refrigerator 3 by way of a pipe P2 so as to be cooled down, and thereafter the cooled feed air is fed to a carbon dioxide eliminator-drier 4 through a pipe P3.

This carbon dioxide eliminator-drier 4 is composed of two molecular sieve columns which will be alternatively switched for use. The feed air is fed to one of them to remove carbon dioxide (CO2) and moisture (H2O) and further sulfides such as SOX and H2S which are catalyst poisons for an oxidation catalyst, by adsorption, while waste gas (impure oxygen gas) which has passed through a main heat exchanger 5, hereinafter mentioned below, is fed to the other molecular sieve column as a regenerating gas for the carbon dioxide eliminator-drier 4.

The feed air, from which carbon dioxide, moisture, sulfides and other impurities have been removed by means of this carbon dioxide eliminator-drier 4, is fed to the main heat exchanger 5 through a pipe P4 so as to be cooled down near to its liquefying point, and then fed to a feed air intake portion 6*a* in the lower portion of a primary rectification column 6 through a pipe P5. To the upper portion of this primary rectification column 6, liquid nitrogen that is one example of cold source is fed through a pipe P6, where the feed air ascending from the lower portion in the rectification portion 6*b* of the primary rectification column 6 and the liquid nitrogen (a reflux liquid) descending from the upper portion of the primary rectification column 6 are brought in contact with each other in a countercurrent state, thereby liquefying oxygen in the feed air and separating low purity nitrogen gas containing the remaining part of oxygen content by rectification.

The said low purity nitrogen gas (i.e. nitrogen gas containing an oxygen content) taken out of the column top of the primary rectification column 6 is led to a nitrogen condenser 7 through a pipe P7 so as to be liquefied by heat exchange with an oxygen-rich liquid, hereinafter mentioned below, and further it is led to a gas-liquid separator 8 through a pipe P8 so as to be subjected to gas-liquid separation. Liquid nitrogen separated here is returned to the upper portion of the primary rectification column 6 through a pipe P9 as a reflux liquid, and raw nitrogen gas also separated here is fed to the main heat exchanger 5 through a pipe P10 so as to be used as a cold source for the main heat exchanger 5.

The raw nitrogen gas which has been raised to normal temperature by itself as a result, is introduced to a recyclic compressor 9 at a pressure of 5.5 ATA through a pipe P11 so as to be compressed to a pressure of 9 ATA, and the compressed raw nitrogen gas is led to an oxidation column 10 packed with an oxidation catalyst through a pipe P12 to oxidize carbon monoxide (CO) and hydrogen (H2) remaining in the raw nitrogen gas to carbon dioxide and water, and then cooled down at a cooler 11 through a pipe P13. After the cooling, the raw nitrogen gas is led to an adsorption column 12 through a pipe P14, where carbon dioxide and water are removed by adsorption, and then it is led to the main heat exchanger through a pipe P15 as feed raw nitrogen gas so as to be liquefied near to its liquefying point, and fed to a feed raw nitrogen intake portion 13*a* in the lower portion of a secondary rectification column 13.

The feed raw nitrogen gas fed in the feed raw nitrogen intake portion 13*a* is brought in contact with the descending reflux liquid as it is ascending in the rectification portions 13*b*, 13*d* of the secondary rectification column 13. As a result, the oxygen content thereof is liquefied and reservoired in the bottom portion of the secondary rectification column 13, as contained in the liquid nitrogen. The rectified nitrogen gas, from which the oxygen content has been removed, is taken out of the top portion of the secondary rectification column 13, and led to a reboiler-condenser 6RC disposed in the lower portion of the primary rectification column 6 or separately placed outside of the primary rectification column 6 through a pipe P17 so as to be liquefied. The obtained liquid nitrogen is returned to a reservoir R1 in the upper portion 13*e* of the secondary rectification column 13 through a pipe P18, and the impurities not liquefied such as helium He, hydrogen H2, neon Ne are discharged out of the lower portion of the reboiler-condenser 6RC through a pipe P19.

The said liquid nitrogen returned to the reservoir R1 of the secondary rectification column 13 is high purity nitrogen which scarcely contains higher boiling point components and lower boiling point components than nitrogen. In order to further decrease the low boiling point components, the liquid nitrogen is caused to flow down in a rectification portion 13*d* lower than the reservoir R1 which is composed of several rectifying trays. Thus, an ultra-high purity nitrogen gas product is taken out of a product take-out portion 13*c* through a pipe P20, led to the main heat exchanger 5 so as be warmed to normal temperature, and passed through a pipe P21 having a particle filter (dust filter) 16 inserted on its way to remove fine dust, and then taken out under about 8 ATA at about 400 Nm3/h as a product gas, and an ultra-high purity liquid nitrogen product is taken out of a reservoir R2 of the secondary rectification column 13 as liquid.

The liquid nitrogen in the bottom portion of the secondary rectification column 13, in which the oxygen content has been enriched, is passed through a pipe P23 so as to be expanded to 5.5 ATA by means of an expansion valve V1 inserted in the pipe P23, and the expanded liquid nitrogen is then fed to the upper portion 6C of the primary rectification column 6 as cold and feed nitrogen so as to be used as a reflux liquid and feed nitrogen to the primary rectification column 6.

The oxygen-rich liquid in the bottom portion of the primary rectification column 6 is passed through a pipe P24 from the bottom portion of the primary rectification column 6 so as to be expanded by means of an expansion valve V2 inserted in the pipe P24, and then fed to a gas-liquid separator 14. A liquid separated in the gas-liquid separator 14 is led from the bottom portion of the gas-liquid separator 14 to the said nitrogen condenser 7 through a pipe P25. In the nitrogen condenser 7, the separated oxygen-rich liquid acts as a cold source so as to be gasified by itself, and the thus-formed oxygen-rich gas is returned to the gas-liquid separator 14 through a pipe P26, where it is led together with the gas formed by gas-liquid separation to the main heat exchanger 5 through a pipe P27 and used as a cold source in the main heat exchanger 5 so that cold is recovered. The gas warmed to normal temperature by this heat exchange is led to the other molecular sieve column of the said carbon dioxide eliminator-drier 4 through a pipe P28 so as to be used as a regenerating gas for the carbon dioxide eliminator-drier 4, and then discharged through a pipe P29 as a waste gas.

Figure 2:
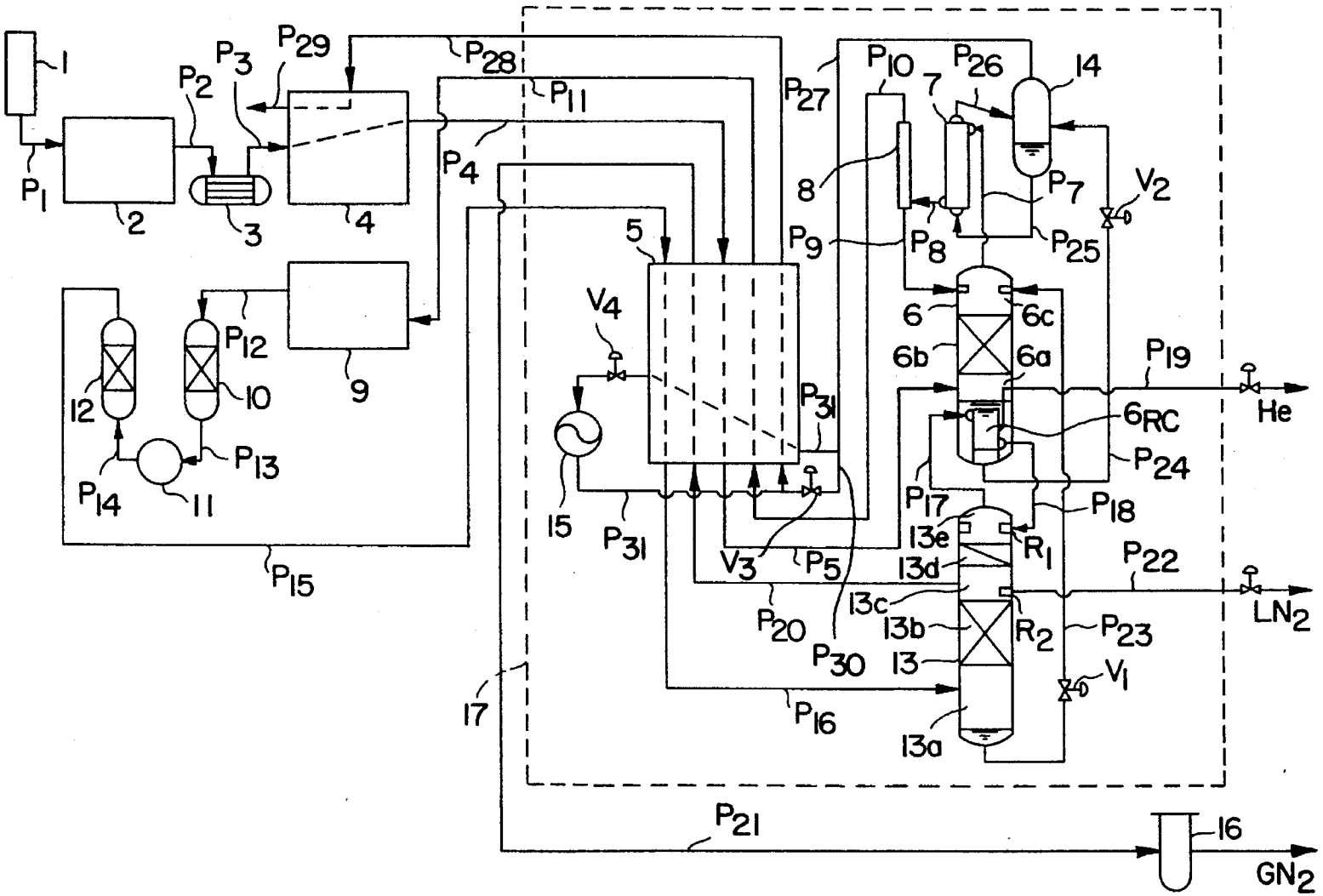
Figure 3:
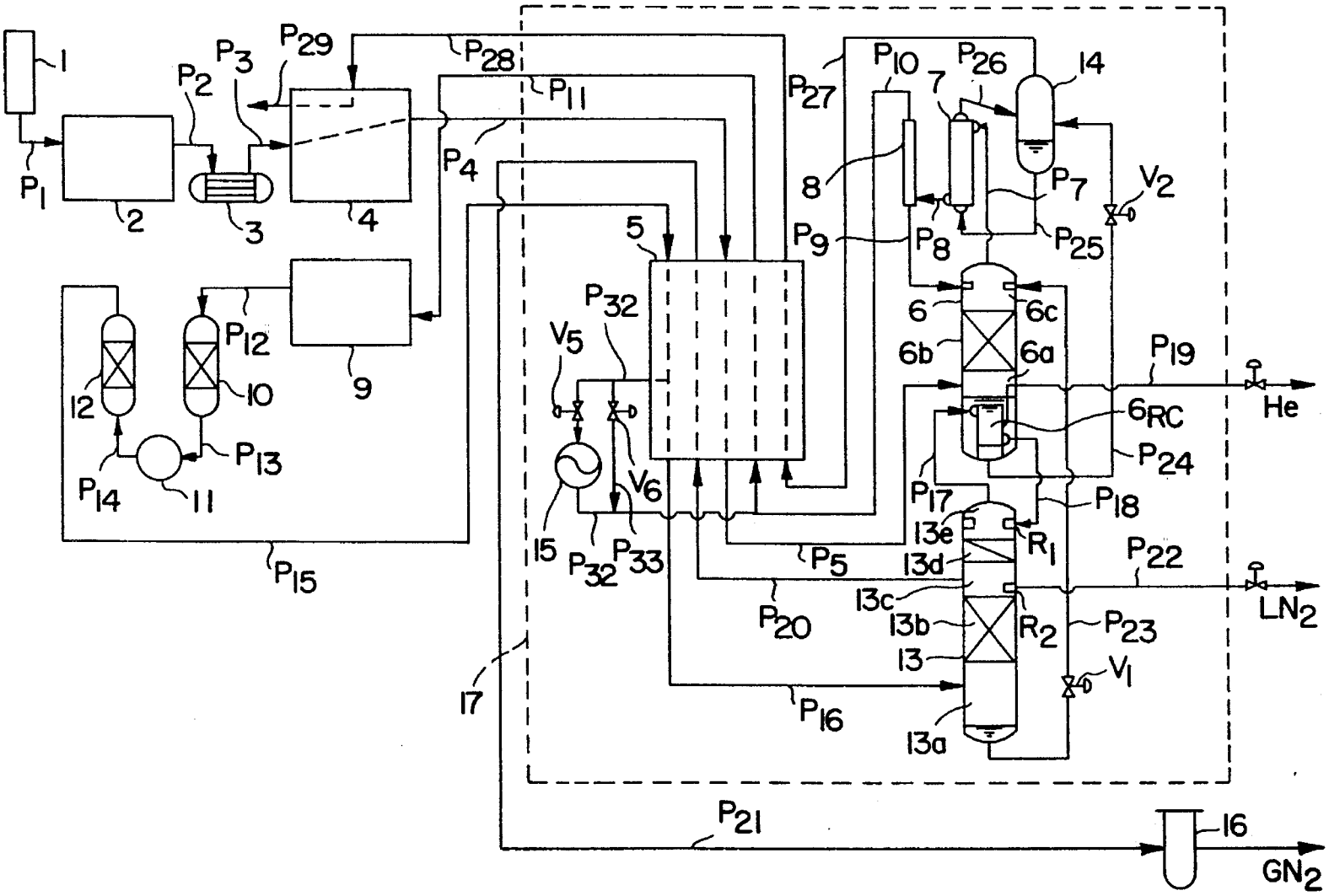

In addition, a part 17 surrounded by a dotted line in FIG. 1 is a cold box, wherein the equipment such as the main heat exchanger 5, primary rectification column 6, reboiler-condenser 6RC, nitrogen condenser 7, gas-liquid separator 8, secondary rectification column 13, gas-liquid separator 14, expansion valves V1, V2 and pipes thereof are accommodated. This cold box 17 is thermally insulated from the atmosphere because of a low temperature portion. In order to supply the shortage of cold, liquid nitrogen in an amount as large as about 1% of the feed air fed to the compressor 2 through the pipe P1 is fed into the primary rectification column 6 from the outside by way of a pipe P6. In the cases of FIG. 2 and FIG. 3 showing the other embodiments mentioned below, the shortage of cold will be generated for use by an expansion turbine 15.

FIG. 2 shows the second embodiment of the present invention. In the first embodiment shown in FIG. 1, by the way, the waste gas (oxygen-rich gas) taken out of the top portion of the said gas-liquid separator 14 through the pipe P27 is directly added into the main heat exchanger 5. However, in the second embodiment shown in FIG. 2, the passage for the said waste gas is divided to two branch paths before it enters the main heat exchanger 5, and a pipe P30 that is one branch path has a shut-off valve V3 inserted therein and a pipe P31 that is the other branch path extends in the main heat exchanger 5 from its low temperature side to a point between the low temperature and high temperature sides and this pipe P31 has a shut-off valve V4 and an expansion turbine 15 inserted outside of the main heat exchanger 5, wherein cold generated by the expansion turbine 15 is joined to the pipe P30 so as to be used as a cold source for the main heat exchanger 5.

In this second embodiment, the open degree of the shut-off valves V3, V4 will be regulated, without carrying out the supply of cold from the outside, thereby regulating the flow rate of the gas passing through the expansion turbine 15 so that the quantity of cold is increased or decreased so as to correspond to the liquid quantity or gas quantity to be taken out as the product. Accordingly, the operation of the whole generator unit can be stabilized.

FIG. 3 shows the third embodiment of the present invention. In the first embodiment shown in FIG. 1, by the way, the feed raw nitrogen gas, from which carbon dioxide and moisture have been removed by adsorption, is introduced to the main heat exchanger 5 through the pipe P16. However, in this third embodiment shown in FIG. 3, a part of the feed raw nitrogen gas is taken out of the main heat exchanger 5 intermediate its low temperature and high temperature sides through the pipe P32, and joined with the raw nitrogen gas for recyclic use taken out of the top portion of the gas-liquid separator 8 through the pipe P10, and the joined flow of nitrogen gas is introduced to the main heat exchanger 5.

The said pipe P32 has a shut-off valve V5 and an expansion turbine 15 inserted in series therein, and a pipe P33 is connected in parallel with both the ends of the shut-off valve V5 and expansion turbine 15 connected in series and this said pipe P33 has a shut-off valve V6 inserted therein. The degree of opening of the shut-off valves V5, V6 will be regulated, thereby regulating the flow rate of the gas passing through the expansion turbine 15 so that the quantity of cold generated by the expansion turbine 15 is increased or decreased. Thus, this cold can be used as a cold source necessary for the operation of the generator unit.

In the ultra-high purity nitrogen generating method and generator therefor according to the present invention, there are obtained such large merits that the activity of the catalyst can be maintained semi-permanently because the feed gas is passed through the catalyst column after catalyst poisons such as SOX and H2S are removed therefrom by normal temperature purification and low temperature liquefaction and rectification, and further the ultra-high purity nitrogen can be recovered at a high yield because the low purity nitrogen separated by low temperature liquefaction and rectification is recycled.

We claim:

1. An ultra-high purity nitrogen generator, which comprises:

a carbon dioxide eliminator-drier for removing, from feed air, carbon dioxide, moisture and catalyst poisons;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a compressor for increasing the pressure of the raw nitrogen gas obtained from the primary rectification column and raising the temperature thereof;

an oxidation column for converting carbon monoxide in the compressed raw nitrogen gas to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product;

a heat exchanger for exchanging heat among the feed air to be introduced to the primary rectification column, the raw nitrogen gas obtained from the primary rectification column, the feed raw nitrogen gas to be introduced to the secondary rectification column and the ultra-high purity nitrogen gas product;

a cold box surrounding the heat exchanger and the primary and secondary rectification columns; and means for removing heat from any of the equipment in the cold box.

2. An ultra-high purity nitrogen generator, which comprises:

a carbon dioxide eliminator-drier for removing, from feed air, carbon dioxide, moisture and catalyst poisons;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for converting carbon monoxide in the compressed raw nitrogen gas to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top portion of the secondary rectification column;

an expansion valve for expanding the liquid nitrogen obtained from the bottom portion of the secondary rectification column and introducing the expanded liquid nitrogen to the primary rectification column as a feed material and refrigerant;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquefied in the nitrogen condenser, the feed raw nitrogen gas to be introduced to the secondary rectification column and the ultra-high purity nitrogen gas product;

a cold box surrounding the heat exchanger, the primary and second rectification columns, the gas-liquid separator, the nitrogen condenser and the reboiler-condenser; and a means for removing heat from any of the equipment in the cold box as cold necessary for the above-mentioned rectification.

3. An ultra-high purity nitrogen generator, which comprises:

a carbon dioxide eliminator-drier for removing, from feed air, carbon dioxide, moisture and catalyst poisons;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for converting carbon monoxide in the compressed raw nitrogen gas to carbon dioxide and hydrogen also contained therein to water; and an adsorption column for cooling down the carbon dioxide and water formed through oxidation and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top portion of the secondary rectification column;

an expansion valve for expanding the liquid nitrogen obtained from the bottom portion of the secondary rectification column and introducing the expanded liquid nitrogen to the primary rectification column as a feed material and refrigerant;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquified in the nitrogen condenser, the feed raw nitrogen gas to be introduced to the secondary rectification column and the ultra-high purity nitrogen gas product; and an expansion turbine for expanding waste gas obtained from the primary rectification column and introducing the expanded waste gas to the heat exchanger as a refrigerant.

4. An ultra-high purity nitrogen generator, which comprises:

a carbon dioxide eliminator-drier for removing, from feed air, carbon dioxide, moisture and catalyst poisons;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for oxidizing the compressed raw nitrogen gas so that carbon monoxide in the raw nitrogen gas is converted to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top portion of the secondary rectification column;

an expansion valve for expanding the liquid nitrogen obtained from the bottom portion of the secondary rectification column and introducing the expanded liquid nitrogen to the primary rectification column as a feed material and refrigerant;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquefied in the nitrogen condenser, the feed raw nitrogen gas to be introduced to the secondary rectification column and the ultra-high purity nitrogen gas product; and an expansion turbine for taking out a part of the feed raw nitrogen gas to be introduced to the secondary rectification column from the heat exchanger and expanding the taken-out nitrogen gas, and introducing the expanded nitrogen gas to the heat exchanger as a refrigerant.

5. An ultra-high purity nitrogen generator according to claim 4, wherein said expansion turbine receives said raw nitrogen gas from a point intermediate the warm and cold sides of said heat exchanger.

* * * * *